US007278638B2

(12) United States Patent
Nordman

(10) Patent No.: US 7,278,638 B2
(45) **Date of Patent: *Oct. 9, 2007**

(54) GAMING DEVICE HAVING DISPLAY WITH AWARD REEL AND ROTATING AND TRANSLATING INDICATOR THEREFORE

(75) Inventor: Dennis Nordman, Lake Villa, IL (US)

(73) Assignee: IGT, Reno, NV (US)

( * ) Notice: Subject to any disclaimer, the term of this patent is extended or adjusted under 35 U.S.C. 154(b) by 387 days.

This patent is subject to a terminal disclaimer.

(21) Appl. No.: 10/660,808

(22) Filed: Sep. 11, 2003

(65) Prior Publication Data

US 2005/0056996 A1 Mar. 17, 2005

(51) Int. Cl.
*A63F 1/00* (2006.01)

(52) U.S. Cl. ..... 273/292

(58) Field of Classification Search ..... 273/143 R; 463/16, 20, 22, 26–27, 30–32
See application file for complete search history.

(56) References Cited

U.S. PATENT DOCUMENTS 2,545,644 A 3/1951 Benton et al.
3,975,022 A 8/1976 Figueroa
4,410,178 A 10/1983 Partridge
4,695,053 A * 9/1987 Vazquez et al. ..... 463/18
4,732,386 A 3/1988 Rayfiel
5,058,893 A 10/1991 Bertram et al.
5,152,529 A 10/1992 Okada
5,364,100 A 11/1994 Ludlow et al.
5,395,111 A 3/1995 Inoue
5,449,173 A 9/1995 Thomas et al.
5,560,603 A 10/1996 Seelig et al.
5,584,763 A 12/1996 Kelly et al.
5,584,764 A 12/1996 Inoue
5,609,524 A 3/1997 Inoue (Continued)

FOREIGN PATENT DOCUMENTS

EP 1003138 A 5/2000

(Continued)

OTHER PUBLICATIONS

4DU Dice Unit Advertisement written by starpoint.uk.com, printed on Sep. 3, 2002.

(Continued)

*Primary Examiner*—Eugene Kim
*Assistant Examiner*—Dolores R. Collins
(74) *Attorney, Agent, or Firm*—Bell, Boyd & Lloyd LLP

(57) ABSTRACT

A display device for a gaming device which includes a symbol display operable to simultaneously display a plurality of symbols. A symbol indicator is positioned adjacent to the symbol display and is operable to translate substantially parallel with respect to the symbol display. The indicator includes a plurality of pointers or arrows operable to spin about an axis that translates with the symbol indicator. In operation, the symbol display simultaneously displays a plurality of symbols from a larger group of symbols, the symbol indicator spins and translates and eventually points to one of the symbols, yielding an outcome that is based on the indicated symbol and a second symbol associated with the pointer that indicates the symbol.

22 Claims, 6 Drawing Sheets

U.S. PATENT DOCUMENTS 5,622,366 A 4/1997 Inoue
5,664,998 A 9/1997 Seelig et al.
5,722,891 A 3/1998 Inoue
5,743,526 A 4/1998 Inoue
5,752,881 A 5/1998 Inoue
5,823,872 A 10/1998 Prather et al.
5,823,874 A 10/1998 Adams et al.
D400,597 S 11/1998 Hedrick et al.
D402,702 S 12/1998 Seelig et al.
5,848,932 A 12/1998 Adams
5,863,249 A 1/1999 Inoue
D406,865 S 3/1999 Heidel
5,882,261 A 3/1999 Adams
5,885,157 A 3/1999 Harada et al.
5,911,418 A 6/1999 Adams et al.
5,927,714 A 7/1999 Kaplan
5,976,015 A 11/1999 Seelig et al.
5,984,782 A 11/1999 Inoue
6,004,207 A 12/1999 Wilson, Jr. et al.
6,059,658 A 5/2000 Mangano et al.
6,062,979 A 5/2000 Inoue
6,086,066 A 7/2000 Takeuchi et al.
6,089,977 A * 7/2000 Bennett ..... 463/20
6,089,978 A 7/2000 Adams et al.
6,105,962 A 8/2000 Malavazos et al.
6,113,098 A 9/2000 Adams
6,142,873 A * 11/2000 Weiss et al. ..... 463/20
6,142,874 A 11/2000 Kodachi et al.
6,159,098 A 12/2000 Slomiany et al.
6,162,121 A 12/2000 Morro et al.
6,173,955 B1 1/2001 Perrie et al.
6,203,429 B1 3/2001 Demar et al.
D441,031 S 4/2001 Seelig et al.
6,213,876 B1 4/2001 Moore, Jr.
6,220,593 B1 4/2001 Pierce et al.
6,224,483 B1 * 5/2001 Mayeroff ..... 463/20
6,227,970 B1 5/2001 Shimizu et al.
D443,313 S 6/2001 Brettschneider
6,251,013 B1 * 6/2001 Bennett ..... 463/13
6,254,481 B1 7/2001 Jaffe
6,267,669 B1 7/2001 Luciano, Jr. et al.
6,270,411 B1 8/2001 Gura et al.
6,302,790 B1 10/2001 Brossard
6,305,686 B1 10/2001 Perrie et al.
6,309,300 B1 * 10/2001 Glavich ..... 463/26
6,311,976 B1 * 11/2001 Yoseloff et al. ..... 273/138.2
6,315,663 B1 11/2001 Sakamoto
6,336,863 B1 * 1/2002 Baerlocher et al. ..... 463/20
6,340,158 B2 1/2002 Pierce et al.
6,368,216 B1 4/2002 Hedrick et al.
6,386,974 B1 5/2002 Adams
6,394,902 B1 * 5/2002 Glavich et al. ..... 463/20
6,398,220 B1 6/2002 Inoue
6,419,579 B1 * 7/2002 Bennett ..... 463/20
6,461,241 B1 10/2002 Webb et al.
D465,531 S 11/2002 Luciano, Jr. et al.
6,481,713 B2 11/2002 Perrie et al.
6,533,273 B2 * 3/2003 Cole et al. ..... 273/138.1
6,533,660 B2 3/2003 Seelig et al.
6,537,152 B2 3/2003 Seelig et al.
6,561,900 B1 * 5/2003 Baerlocher et al. ..... 463/20
6,565,433 B1 * 5/2003 Baerlocher et al. ..... 463/20
6,569,015 B1 * 5/2003 Baerlocher et al. ..... 463/16
6,582,307 B2 6/2003 Webb
6,609,972 B2 8/2003 Seelig et al.
6,609,974 B2 * 8/2003 Mead et al. ..... 463/25
6,612,575 B1 * 9/2003 Cole et al. ..... 273/138.1
6,634,945 B2 * 10/2003 Glavich et al. ..... 463/25
6,663,489 B2 * 12/2003 Baerlocher ..... 463/20
6,692,355 B2 * 2/2004 Baerlocher et al. ..... 463/16
6,712,694 B1 * 3/2004 Nordman ..... 463/20
6,715,756 B2 * 4/2004 Inoue ..... 273/143 R
6,726,565 B2 * 4/2004 Hughs-Baird ..... 463/25
6,758,473 B2 * 7/2004 Seelig et al. ..... 273/143 R
6,780,103 B2 * 8/2004 Bansemer et al. ..... 463/7
6,855,056 B2 * 2/2005 Inoue ..... 463/31
6,905,407 B2 * 6/2005 Nordman ..... 463/20
6,960,134 B2 * 11/2005 Hartl et al. ..... 463/20
2001/0024971 A1 9/2001 Brossard
2002/0094861 A1 7/2002 Seelig et al.
2002/0094862 A1 7/2002 Inoue
2002/0142829 A1 10/2002 Inoue
2003/0040358 A1 2/2003 Rothkranz et al.
2003/0064790 A1 4/2003 Hughs-Baird et al.
2003/0078089 A1 4/2003 Gary et al.
2003/0232643 A1 12/2003 Inoue
2004/0000754 A1 1/2004 Inoue
2004/0009807 A1 1/2004 Miller et al.
2004/0012145 A1 1/2004 Inoue
2004/0014516 A1 1/2004 Inoue
2004/0014517 A1 * 1/2004 Inoue ..... 463/20
2004/0017041 A1 * 1/2004 Inoue ..... 273/143 R
2004/0018866 A1 * 1/2004 Inoue ..... 463/16
2004/0026854 A1 2/2004 Inoue
2004/0036218 A1 2/2004 Inoue
2004/0038726 A1 2/2004 Inoue
2004/0041340 A1 3/2004 Inoue
2004/0053658 A1 3/2004 Rothranz
2004/0053659 A1 3/2004 Rothkranz et al.
2004/0053670 A1 3/2004 Rothkranz et al.
2004/0053671 A1 3/2004 Nordman
2004/0053685 A1 3/2004 Seelig et al.
2004/0053687 A1 * 3/2004 Nordman et al. ..... 463/30
2004/0121840 A1 * 6/2004 Rosander et al. ..... 463/31
2004/0150161 A1 * 8/2004 Inoue ..... 273/292
2004/0155399 A1 8/2004 Inoue
2004/0157658 A1 8/2004 Rothkranz
2004/0180715 A1 9/2004 Nordman
2004/0183251 A1 9/2004 Inoue

FOREIGN PATENT DOCUMENTS

GB 912685 12/1962
GB 2201821 A 9/1987
GB 2383668 A 11/2001
JP 2002-320703 11/2002

OTHER PUBLICATIONS

American Bandstand Brochure written by Anchor Games, published in 2001.
Big Shot!™ Advertisement published by Aristocrat Technologies, Inc., published in 2002.
Big Top Keno Advertisement published by Aristocrat Technologies, Inc., published in 2000.
Bonus Roulette Brochure written by F. Franco, published prior to Sep. 11, 2003.
Buck's Roulette Brochure written by R. Franco, published prior to Sep. 11, 2003.
Chariot's of Fortune Brochure written by R. Franco, published prior to Sep. 11, 2003.
Classic Pot of Gold Brochure written by Ace Coin Equipment Ltd., published prior to Sep. 11, 2003.
Cyberdyne Gaming Brochure written by Cyberdyne Gaming, published prior to Sep. 11, 2003.
Double Diamond Girls Advertisement, written by A.C. Coin and Slot Services Company, published prior to Sep. 11, 2003.
Elvira® Mistress of the Dark™ Advertisement written by IGT, published in 2002.
Elvis Hits Advertisement written by IGT, published in 1999.
Holy Smoke Brochure written by Impulse Gaming Ltd., published prior to Sep. 11, 2003.
Honeymooners Advertisement, written by AC Coin & Slot, published in 2002.

Jack and the Beanstalk™ Brochure written by AC Coin & Slot, published prior to Sep. 11, 2003.
Jackpot Hotline Advertisement, written by AC Coin & Slot, published prior to Sep. 11, 2003.
King of the Grill™ Brochure written by AC Coin & Slot, published prior to Sep. 11, 2003.
Lemons, Cherries and Bell-Fruit-Gum written by Richard M. Bueschel, pp. 39-41, 64, 70, 137, 149-150, 195-196 and 251, 1995.
Line-Up Brochure written by AC Coin & Slot, published prior to Sep. 11, 2003.
Little Green Men Jr.™ Advertisement written by AC Coin & Slot, published prior to Sep. 11, 2003.
Little Green Men Jr.™ Article written by Strictly Slots, published in Feb. 2003.
Miss America Brochure written by AC Coin & Slot, published prior to Sep. 11, 2003.
Mix and Match Article written by Strictly Slots, published in Apr. 2002.
Mix and Match Advertisement published by AC Coin & Slot, published prior to Sep. 11, 2003.
Money Grab Article written by Strictly Slots, published in Apr. 2001.
Monster Match Game Description by Strictly Slots, published by AC Coin & Slots prior to Sep. 9, 2003.
Monster Match Advertisement by Strictly Slots, published prior to Sep. 9, 2003.
Monster Match Article, published by Strictly Slots, published in Jan. 2002.
On The Money! Article written by Strictly Slots, published in Dec. 2000.
Payout!™ Advertisement written by www.csds.com/Gaming/Products/g_Payout.htm, printed on Jan. 15, 2001.
Payout!™ Article written by Casino Data Systems, published prior to Sep. 11, 2003.
Pick a Prize Brochure written by Acres Gaming Incorporated, published prior to 2001.
Power Slotto Brochure published by AC Coin & Slot prior to 2002.
Press Your Luck Brochure published by AC Coin & Slot prior to 2002.
Quick Pick Paytime Brochure written by Acres Gaming Incorporated, published prior to 2001.
R&B™ Brochure published by AC Coin & Slot, published prior to Sep. 11, 2003.
Reel Dice Advertisement written by Gerber & Glass, published in 1936.
Royal Roulette Brochure written by Impulse Gaming, Ltd., published prior to Sep. 11, 2003.
Slot Machine Buyer's Handbook, A Consumer's Guide to Slot Machines written by David L. Saul and Daniel R. Mead, published in 1998.
Silver City Roundup Brochure published by AC Coin & Slot, published prior to Sep. 11, 2003.
Slot Machines A Pictorial History of the First 100 Years, 5th edition written by Marshall Fey, published in 1983-1997.
Slot Machines and Coin-Op Games written by Bill Kurtz, pp. 16, 65, 105 and 111, 1991.
Slot Machines on Parade, 1st edition written by Robert N. Geddes and illustrated by Daniel R. Mead, published in 1980.
Spin-A-Lot Brochure written by Acres Gaming Incorporated, published prior to 2001.
Take Your Pick Article written by Strictly Slots, published in Mar. 2001.
Yahtzee Bonus Advertisement written by Mikohn, published in 1999.

* cited by examiner

GAMING DEVICE HAVING DISPLAY WITH AWARD REEL AND ROTATING AND TRANSLATING INDICATOR THEREFORE

BACKGROUND OF THE INVENTION

The present invention relates to gaming devices. More particularly, the present invention relates to wagering gaming device displays.

Gaming devices, such as slot machines and video poker machines, provide fun and excitement to the player. Gaming, in general, provides an escape from the everyday rigors of life. Gaming devices use bright lights and exciting sounds to set the gaming device apart from other gaming devices. Gaming devices, in particular, use one or more displays that enable the player to see and play the game. The displays typically portray the action of the game and ultimately indicate whether or not the player wins.

Slot machine and other gaming device displays have gone through a number of transitions since their inception. Originally, slot machines displayed purely mechanical reels. While these machines gained enormous popularity, the mechanical nature of the reels limited the number of pay-stops, which limited the number of different symbols and the number of different winning symbol combinations.

The advent of the computer and the video monitor expanded the possibilities for gaming devices. There are now video poker, video blackjack and other types of video gaming machines. Video displays have also been implemented in slot machines. The video slot machines use computers to randomly generate symbol combinations from an expanded number of different symbols. Video reel strips can include a virtually unlimited number of symbols, which enables a wide variety of different symbol combinations to be employed, including combinations that appear very infrequently and yield high payouts.

With slot machines, the video monitors have also been used to provide bonus or secondary games. Bonus games in gaming machines have become much more prevalent and elaborate in recent years. For example, players play the base game of slot until becoming eligible for a bonus game. The base game temporarily pauses, while the player plays the bonus game. When the player completes the bonus game, the gaming device returns the player to the bonus game.

It should therefore be appreciated that a single video monitor is often sufficient to provide both the base game of slot and one or more bonus games that become triggered by the slot game. As illustrated in FIG. 1B, there is room on the cabinet of gaming device 10*b* for an upper display area 32. This area, however, is often not utilized for gaming purposes and may simply provide a paytable, graphics and/or lettering that pertains to a theme of the gaming device.

Video monitors and in particular video-based slot machines are likely going to continue growing in popularity. As the video monitor has been used more and more, however, there has been a growing sentiment that some of the mystique of the old time mechanical gaming devices is lost when mechanical reels and mechanical displays are replaced by a video monitor.

Accordingly, a need exists to provide a gaming device that may use a video monitor, which provides increased flexibility to the gaming device to add more symbols and more elaborate bonus games, while providing some aspect of the gaming device that is mechanical and provides a fun and exciting mechanical display.

SUMMARY OF THE INVENTION

The present invention provides a display device for a gaming device and in one embodiment a mechanical display device for a slot machine. The display device includes a symbol display or member operable to simultaneously display a sub-set of plurality of symbols from a set or group of a plurality of symbols. In one embodiment, the symbol display includes an electromechanical rotating reel, however, the symbol display is alternatively a video display or other suitable display. The display device also includes a symbol indicator positioned adjacent to the symbol display. The symbol indicator is operable to move or translate in a substantially parallel manner to the symbol display. The symbol indicator includes a plurality of pointers or arrows and is operable to spin about an axis. In operation of one embodiment, the symbol display generates and simultaneously displays a plurality of symbols from the larger group of symbols, the symbol indicator simultaneously spins and translates and eventually points to one of the symbols, yielding an outcome that is based on the indicated symbol.

The symbols can represent various types of awards that the player can win such as game credits, game credit multipliers, a number of free spins, a number of free games, a number of picks from a prize pool, an entry into a bonus game and/or any combination thereof. The outcome is therefore in one embodiment an award for the player.

In one embodiment, the outcome or award is based on the symbol indicated by the rotating and translating symbol indicator as well as a second symbol that is associated with the particular pointer of the indicator that indicates the symbol on the symbol display. For example, the symbol display or reel can display a credit value and the pointer of the indicator can display a multiplier. The player's outcome or award is then the credit value, which is indicated by the indicator, multiplied by the multiplier value associated with the particular pointer of the indicator that ultimately indicates the indicated symbol on the symbol display.

In one embodiment, the display device of the present invention is used in combination with a primary game, such as slot, poker, keno, blackjack, craps, bingo, lotto as well as other base or primary games. In combination with slot, for example, a particular symbol or a combination of symbols generated on slot machine reels can trigger a bonus event or an activation of the display device of the present invention. The display device can execute a display sequence or wait for an input from the player to execute the display sequence.

The display device of the present invention is fun and exciting for a player in part because it provides multiple simultaneously or sequentially moving parts that each provide a component of the player's overall outcome or award. The sequential movement or stopping of the members can be controlled to build excitement for the player as one or more of the components are sequentially indicated. In operation, the symbol display such as the mechanical reel or video display of symbols moves or generates symbols. At the same or different time, the rotating and translating symbol indicator translates and rotates. In one embodiment, the translation and rotation occur at the same time. Alternatively, the translation and rotation occurs at different times. Eventually, the symbol display displays a subset of symbols from the overall possible set of symbols. The indicator translates to a particular position relative to the symbol display and the symbol indicator rotates and eventually stops with one of its pointers pointing towards and thereby indicating one of the symbols of the symbol display. The gaming device then provides an outcome or award to the player based on the symbol of the symbol display and the symbol of the selected pointer to the player. It should be appreciated that the present invention may be employed and suitably adapted for a primary game or a secondary game.

The gaming device includes internally a plurality of motion producing devices or stepper motors that create the motion of the mechanical reel and the rotating translating indicator. The stepper motors are programmable to run a multitude of different motion control profiles that provide fun and excitement for the player to watch. In one embodiment, the gaming device randomly generates an award or outcome for the player and the motion profile is selected to carry out and eventually produce the randomly generated outcome.

It is therefore an advantage of the present invention to provide a fun and exciting gaming device display.

It is another advantage of the present invention to provide a display device having multiple rotating and translating parts.

Moreover, it is an advantage of the present invention to add a mechanical element to a video based gaming machine.

Still further, it is an advantage of the present invention to provide a bonus game or bonus display device that is operable with a multitude of different primary games.

Additional features and advantages of the present invention are described in, and will be apparent from, the following Detailed Description of the Invention and the figures.

DETAILED DESCRIPTION OF THE INVENTION

The present invention provides a display and display indicators that operate with a multitude of primary or base wagering games, including but not limited to the games of slot, poker, keno, blackjack, bunco and checkers. In an embodiment, the display and indicators operate in conjunction with secondary or bonus games, which in turn operate in conjunction with the above listed primary games. Besides such base and bonus games, the present invention can operate with any of the bonus triggering events, as well as any progressive game coordinating with these base games. The symbols and indicia used for any of the primary or base games, bonus or secondary games or progressive games include any suitable symbols, images or indicia.

Figure 1A:
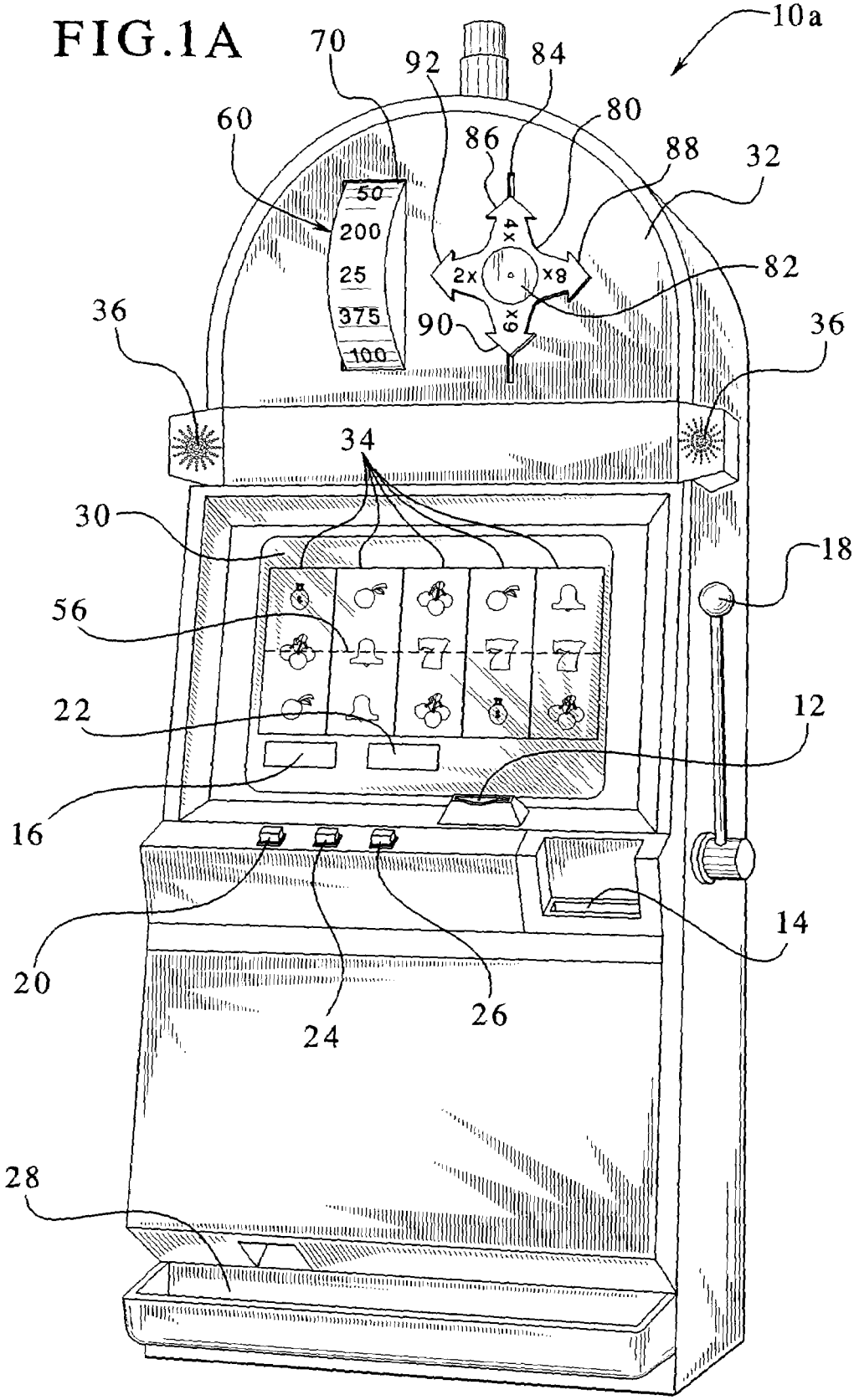
FIGS. 1A and 1B are perspective views of alternative embodiments of the gaming device of the present invention.
Figure 1B:
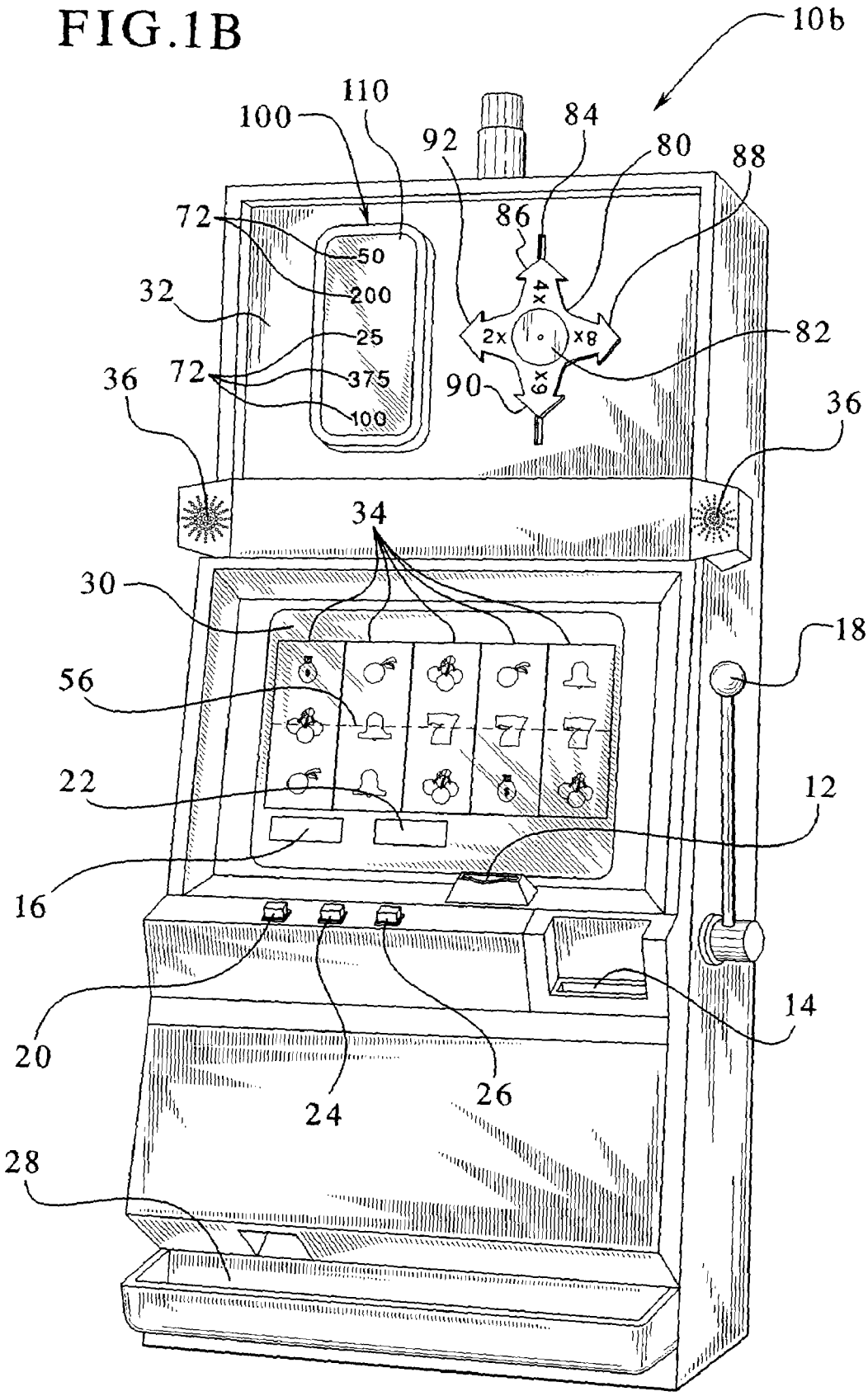

One primary embodiment for the display and display indicators is with a slot game. Referring now to the drawings, and in particular to FIGS. 1A and 1B, one slot machine embodiment is illustrated. Gaming devices 10*a* and 10*b* illustrate two possible cabinet styles and display arrangements and are collectively referred to herein as gaming device 10. Gaming device 10 is illustrated as having the controls, displays and features of a conventional slot machine, wherein the player operates the gaming device while standing or sitting. Gaming device 10 also includes being a pub-style or table-top game (not shown), which a player operates while sitting.

Gaming device 10 includes monetary input devices. FIGS. 1A and 1B illustrate a coin slot 12 for coins or tokens and/or a payment acceptor 14 for cash money. The payment acceptor 14 also includes other devices for accepting payment, such as readers or validators for credit cards, debit cards or smart cards, tickets, notes, etc. When a player inserts money in gaming device 10, a number of credits corresponding to the amount deposited is shown in a credit display 16. After depositing the appropriate amount of money, a player can begin the game by pulling arm 18 or pushing play button 20. Play button 20 can be any suitable play activator used by the player which starts any game or sequence of events in the gaming device.

As shown in FIGS. 1A and 1B, gaming device 10 also includes a bet display 22 and a bet one button 24. The player places a bet by pushing the bet one button 24. The player can increase the bet by one credit each time the player pushes the bet one button 24. When the player pushes the bet one button 24, the number of credits shown in the credit display 16 decreases by one, and the number of credits shown in the bet display 22 increases by one. A player may cash out by pushing a cash out button 26 to receive coins or tokens in the coin payout tray 28 or other forms of payment, such as an amount printed on a ticket or credited to a credit card, debit card or smart card. Well known ticket printing and card reading machines (not illustrated) are commercially available.

Gaming device 10 also includes one or more display devices. The embodiments shown in FIGS. 1A and 1B include a display device 30 and a cabinet having an upper display area 32. The display device includes any viewing surface such as glass, a video monitor or screen, a liquid crystal display or any other static or dynamic display mechanism. In a video poker, blackjack or other card gaming machine embodiment, the display device includes displaying one or more cards. In a keno embodiment, the display device includes displaying numbers.

The display devices 60 and 100 of the present invention are provided, in one embodiment, in the upper display area 32 on the cabinets of gaming devices 10*a* and 10*b* of FIGS. 1A and 1B. Display devices 60 and 100 are provided, in another embodiment, on top of the rounded cabinet of gaming device 10*a* or rectangular cabinet of gaming device 10*b*. In a further embodiment, the top portion or top box of the gaming device is removed, creating a lower profile machine. Here, the display devices 60, 100 of the present invention sit on top of gaming device 10 but are lower to the ground than if the top box is not removed.

The slot machine embodiment of gaming device 10 includes a plurality of reels 34, for example three to five reels 34. Each reel 34 includes a plurality of indicia such as bells, hearts, fruits, numbers, letters, bars or other images which correspond to a theme associated with the gaming device 10. If the reels 34 are in video form, the display device displaying the video reels 34 is, in one embodiment, a video monitor. Gaming device 10 includes speakers 36 for making sounds or playing music.

With reference to the slot machine base game of FIGS. 1A and 1B, to operate the gaming device 10, the player inserts the appropriate amount of tokens or money in the coin slot 12 or the payment acceptor 14 and then pulls the arm 18 or pushes the play button 20. The reels 34 then begin to spin. Eventually, the reels 34 come to a stop. As long as the player has credits remaining, the player can spin the reels 34 again. Depending upon where the reels 34 stop, the player may or may not win additional credits.

In addition to winning base game credits, the gaming device 10, including any of the base games disclosed above, also includes bonus games that give players the opportunity to win credits. The gaming device 10 employs a video-based display device 30 for the bonus games. The bonus games include a program that automatically begins when the player achieves a qualifying condition in the base game.

Figure 2:
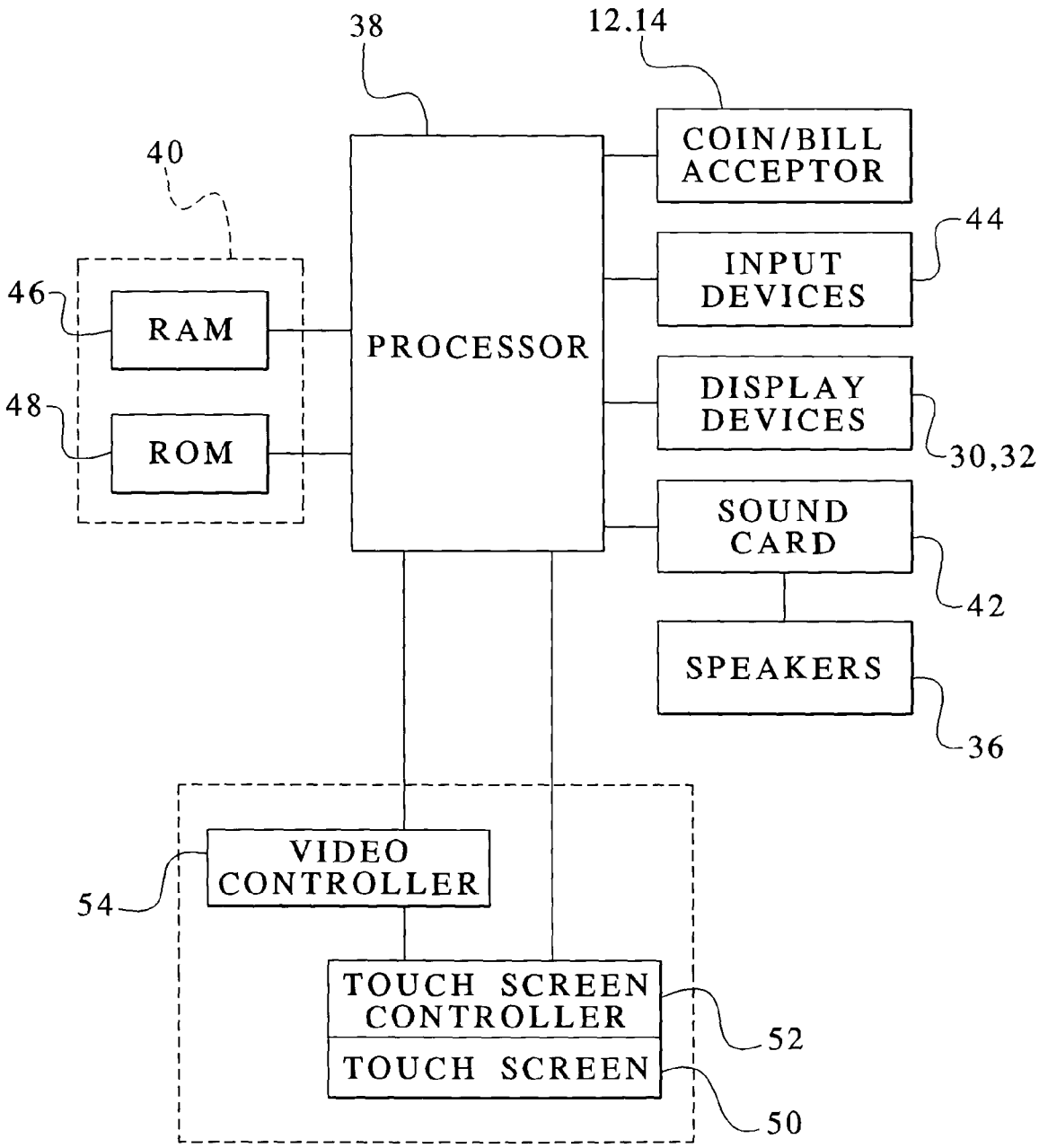
FIG. 2 is a schematic block diagram of the electronic configuration of one embodiment of the gaming device of the present invention.

Referring now to FIG. 2, one embodiment of an electronic configuration for gaming device 10 includes: a processor 38; a memory device 40 for storing program code or other data; a display device 30; a sound card 42; a plurality of speakers 36; and one or more input devices 44. The processor 38 is a microprocessor based platform that is capable of displaying images, symbols and other indicia such as images of people, characters, places, things and faces of cards. The memory device 40 includes random access memory (RAM) 46 for storing event data or other data generated or used during a particular game. The memory device 40 also includes read only memory (ROM) 48 for storing program code, which controls the gaming device 10 so that it plays a particular game in accordance with applicable game rules and pay tables.

As illustrated in FIG. 2, the player uses the input devices 44 to input signals into gaming device 10. In the slot machine base game, the input devices 44 include the pull arm 18, play button 20, the bet one button 24, the cash out button 26 and other player inputs. A touch screen 50 and touch screen controller 52 are connected to a video controller 54 and processor 38. The touch screen enables a player to input decisions into the gaming device 10 by sending a discrete signal based on the area of the touch screen 50 that the player touches or presses. As further illustrated in FIG. 2, the processor 38 connects to the coin slot 12 or payment acceptor 14, whereby the processor 38 requires a player to deposit a certain amount of money to start the game.

The processor 38 also controls the output of one of more motion controllers 56 that control one or more motion producing devices 58. The motion producing devices 58 can be any combination of motors, stepper motors, linear stepper motors or other types of linear actuators. The motion controllers 56 typically include printed circuit boards or stand alone enclosures that receive high level commands from the processor 38. The motion controller 56 converts the high level commands, for example, into a number of step pulses, which in turn are converted into motor currents. The stepper motor or other type of motion producing device 58 receives the currents, wherein the currents cause, for example, a rotor to turn within a stator a precise and desired amount.

As described more fully below, the rotational motion of a motor 58 can be used to create translational motion for the symbol indicator 80. Otherwise, a linear motion producing device 58 can be used to directly cause a portion of the symbol indicator 80 to translate. Motors 58 are also used to rotate the symbol indicator 80 and the reel 70 of the respective display device.

The motion control scheme facilitates complex movements of multiple parts to be programmed into the memory device 40 and carried out by the processor 38 at the appropriate time in the sequence of the game, be it a base, bonus, bonus triggering or progressive sequence of gaming device 10. The motion sequences are alternatively stored in the motion controllers 56. Moreover, multiple programs can be implemented in the memory device 40, wherein the processor runs the appropriate program at the appropriate time, and wherein the members and indicators described below can perform or move differently, e.g., faster, slower or in different directions at different times, at different points in the game and in different sequences.

The motion control programs, in an embodiment, interface with one or more random generation devices, typically software based items, to produce randomly displayed outcomes on the displays and indicators of the present invention. For example, the processor runs a random selection sequence to receive a result and then commands that a particular motion control program be run to achieve the result. The result is therefore determined, in one embodiment, before or during the actual movement of the symbol display and indicator(s).

Figure 3:
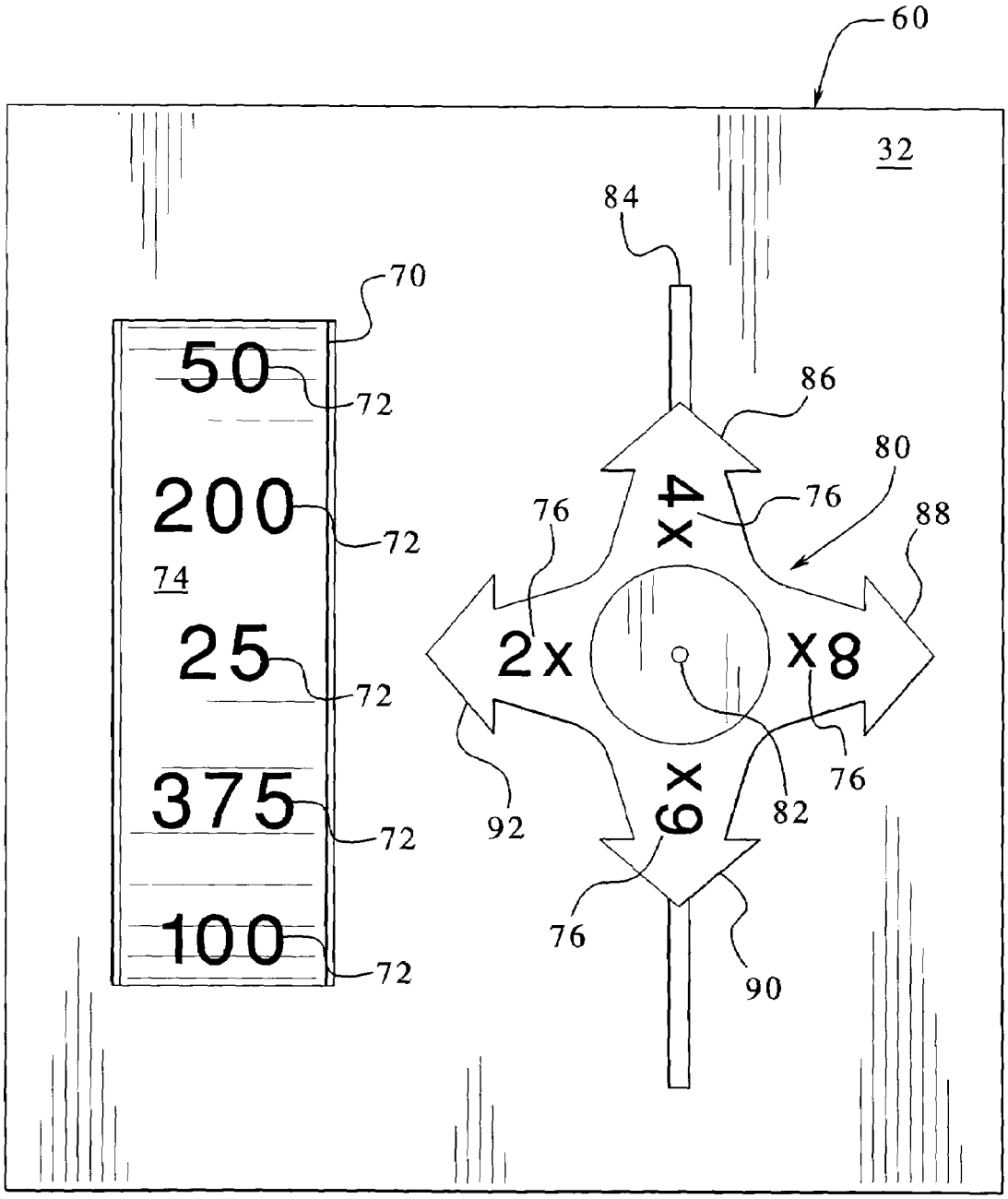
FIG. 3 is an elevation view of the upper display area illustrated in FIGS. 1A and 1B having one embodiment of the display of the present invention.

Referring now to FIG. 3, display device 60 illustrates one embodiment of the present invention. Display device 60 is provided on the upper display area 32 in one embodiment as shown in FIGS. 1A and 1B. Display device 60 includes a symbol display such as an electromechanical reel 70 and a rotating and translating symbol indicator 80. The primary difference between the display device 60, shown also in FIG. 1A, and display device 100, shown in FIG. 1B, is that the electromechanical reel 70 of display device 60 is replaced by a video monitor 110 in the display device 100. In either case, the symbol display (including the reel 70 and the video monitor 110) each display a plurality of symbols 72. In display device 100, symbols 72 are generated and displayed on video monitor 110. In display 60, symbols 72 are generated and displayed by reel 70. In both cases, symbols 72 are preferably generated and selected from a larger set of symbols.

Symbols 72 of reel 70 are displayed on reel strip 74. Reel strip 74 includes symbols that are not visible from the outside of gaming device 10. Thus, at any given rotation of reel 70, the five symbols 72 displayed can collectively be a valuable set of five symbols or a lesser valued set of five symbols. The rotation of reel 70 therefore provides one variable component of the outcome or award adopted to be displayed by display device 60.

Likewise, video symbols 72 displayed on video monitor 110 of display device 100 are generated from a larger set of symbols. In display device 100, video monitor 110 can sequentially flash different values or show the symbols 72 scrolling up and down in a similar manner to an electromechanical reel to show that the gaming device 10 is "thinking" about or deciding which symbols to ultimately display to the player.

Each of the display devices 60 and 100 includes a rotating and translating symbol indicator 80. Symbol indicator 80 rotates about an axis 82. Additionally, symbol indicator 80 translates along a line or slot 84 defined by the panel of upper display area 32. This movement is in one embodiment parallel or substantially parallel to the movement of the symbols of the symbol display.

Symbol indicator 80 includes a plurality of pointers 86, 88, 90 and 92. Pointers 86, 88, 90 and 92 sequentially point towards member 70 or 110 as the symbol indicator 80 spins about axis 82. Additionally, as the different pointers 86, 88, 90 and 92 point sequentially towards the reel 70 or video monitor 110, symbol indicator 80 as a whole translates up and down so that different positions on reel 70 or video monitor 110 are sequentially indicated. Those positions in turn display different symbols 72 at different times.

In the illustrated embodiment, each of the pointers 86, 88, 90 and 92 is associated with an individual symbol 76. In the illustrated embodiment, symbols 76 are multipliers. The symbol 76 or multiplier associated with each of the pointers 86, 88, 90 and 92 operable to point towards reel 70 or video monitor 110 is provided as an additional component to the player's outcome or award. In the embodiment illustrated by display device 60 of FIG. 3, the player's award is the indicated symbol 72 multiplied by the symbol 76 associated with the indicating pointer 92. As illustrated, the player's outcome or award is twenty-five credits multiplied by two or fifty credits.

Figure 4:
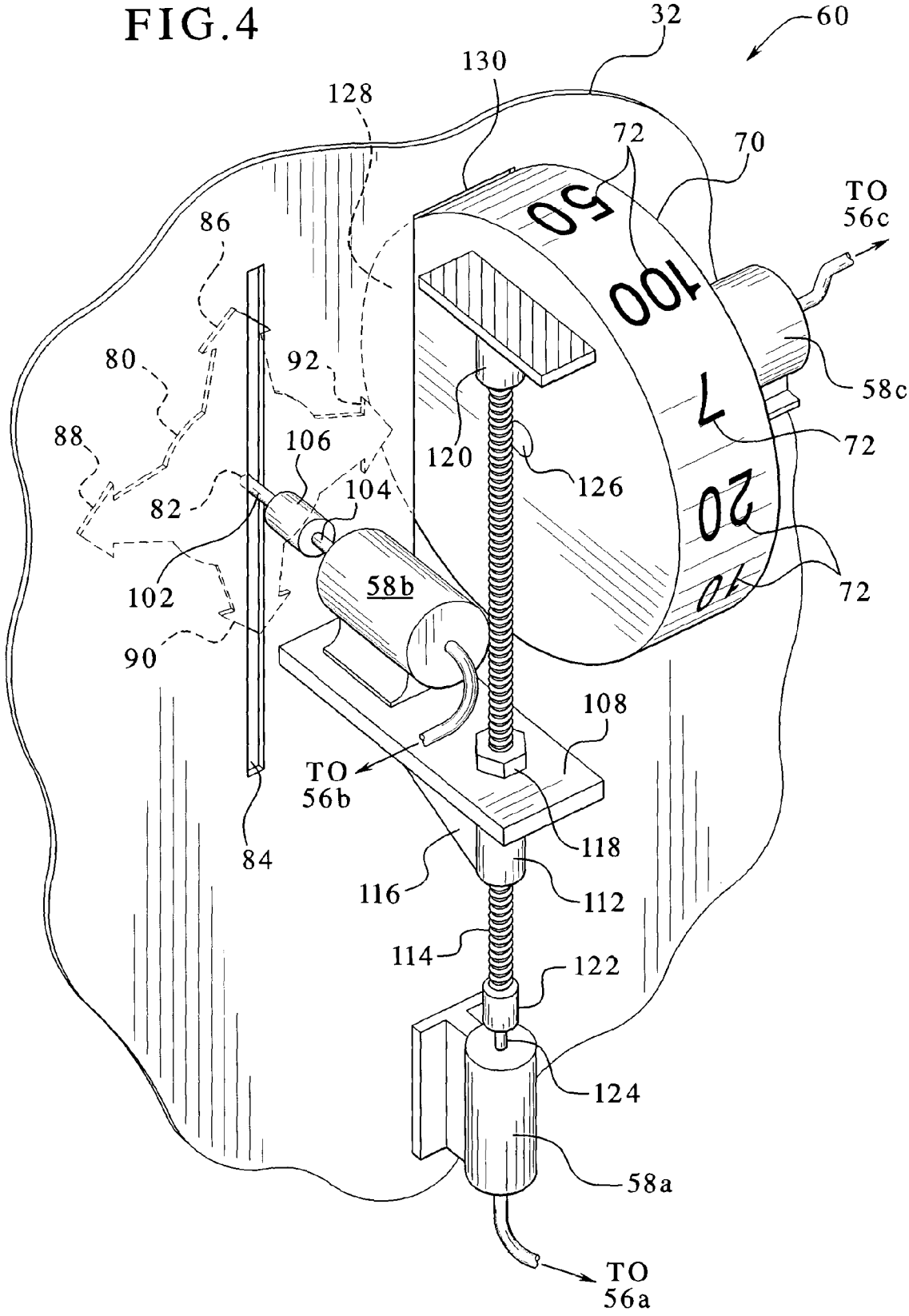
FIG. 4 is a perspective view of the inside of the upper display area showing one embodiment for producing the multiple different motions for the components of the display device.

Referring now to FIG. 4, one embodiment of a motion control scheme or apparatus to produce the various motions described above in connection with FIG. 3 is illustrated. In FIG. 4, three motion producing devices or stepper motors 58*a*, 58*b* and 58*c* are employed. Each of those motion producing devices 58*a*, 58*b* and 58*c* includes an electrical attachment to a suitable motion controller 56*a*, 56*b* and 56*c*, respectively. In another embodiment, a single motion controller can control each of the motion producing devices 58*a*, 58*b* and 58*c*.

The view of FIG. 4 is from inside gaming device 10 at the inner wall of upper display area 32. Accordingly, slot 84 defined by the panel of upper display area 32 is illustrated. Although not illustrated, it should be appreciated that flaps or other suitable types of camouflage devices may be provided, so that the player cannot readily discern that slot 84 exists, cannot view into the inside of gaming device 10 and so that dirt and other debris cannot collect inside gaming device 10. It should also be appreciated that the display device will be mounted in a suitable protective housing (not shown) to protect the display device of the present invention from tampering and damage. The axis 82 of symbol indicator 80 is set by a mounting shaft 102 suitably affixed to the back side of symbol indicator 80. Shaft 102 extends through slot 84 and is sized slightly smaller than the width of slot 84 so that shaft 102 can translate up or down within slot 84. Mounting shaft 102 of symbol indicator 80 is coupled to motor output shaft 104 of motion producing device 58*b* via a suitable flex coupler 106.

Stepper motor 58*b* is controlled by motion controller 56*b*, which receives pulse signals from processor 38 or a separate motion control processor (not illustrated). In any case, stepper motor 58*b*, as is the case with each of the motion producing devices (collectively referred to as motion producing devices 58), is controlled by a suitable computer program. The program can cause the rotation of symbol indicator 80 in a multitude of directions at a multitude of different times, at a multitude of different angular accelerations and angular velocities. In short, stepper motor 58*b* has the flexibility to produce any suitable type of desired rotational motion within the limits and capabilities of the speed-torque curve of motor 58*b*.

In the illustrated embodiment motion producing device 58*b* is mounted to mount 108. Mount 108 includes a collar 112 which is journaled about a lead screw 114. A gusset 116 supports the mounting surface of mount 108 with respect to the load placed on such surface via the cantilever caused by motor 58*b* and symbol indicator 80. Mount 108 also includes a threaded portion or welded nut 118, which threadingly receives the shaft or lead screw 114. Shaft 114 is mounted at one end to a fixed bearing 120 and is coupled at the other end via a flex coupler 122 to output shaft 124 of motion producing device or stepper motor 58*a*.

Stepper motor 58*a* turns lead screw 114 within the threads of threaded device 118 to cause mount 108 to move up or down accordingly. A guide, not illustrated, is provided so that mount 108 does not wiggle about shaft 114 as the shaft turns and as mount 108 moves vertically. The lead screw arrangement in combination with stepper motor 58*a* provides a highly accurate and versatile mode of converting the rotational output of output shaft 124 of stepper motor 58*a* to the translational motion ultimately of symbol indicator 80.

It should be appreciated that along with symbol indicator 80, the stepper motor 58*a* moves stepper motor 58*b* as well as mount 108 up and down. Accordingly, stepper motor 58*a* is sized appropriately for such task. As above with stepper motor 58*b*, stepper motor 58*a* is controlled by a suitable computer program, which can store complex motion profile programs that set the acceleration, velocity and ultimate distance that symbol indicator 80 translates within slot 84. Although not illustrated, display device 60 includes in one embodiment safety limit switches so that if the stepper motor 58*a* loses its ability to accurately know where mount 108 is with respect to the top and bottom of slot 84, the hard limit switches are triggered if shaft 102 of indicator 80 moves too close to either the top or bottom of slot 84.

In the embodiment illustrated in FIG. 4, reel 70 of display device 60 is operated in the typical manner for operating slot machine reels, that is, via a single, centrally located stepper motor 58*c*, which rotates reel 70 about a pivot point 126. Reel 70 can be turned in either direction, at variable angular accelerations and velocities for any suitable number of rotations. The configuration of reel 70 in FIG. 4 is such that a fairly significant portion 128 of reel 70 extends outside of a large aperture 130 defined by the panel of upper display area 32. Such an extension 128 may not be desirable in combination with symbol indicator 80. That is, the extension 128 may make it difficult for the pointers 86, 88, 90 and 92 to appear to accurately point towards a given one of the symbols 72 on reel 70.

Figure 5:
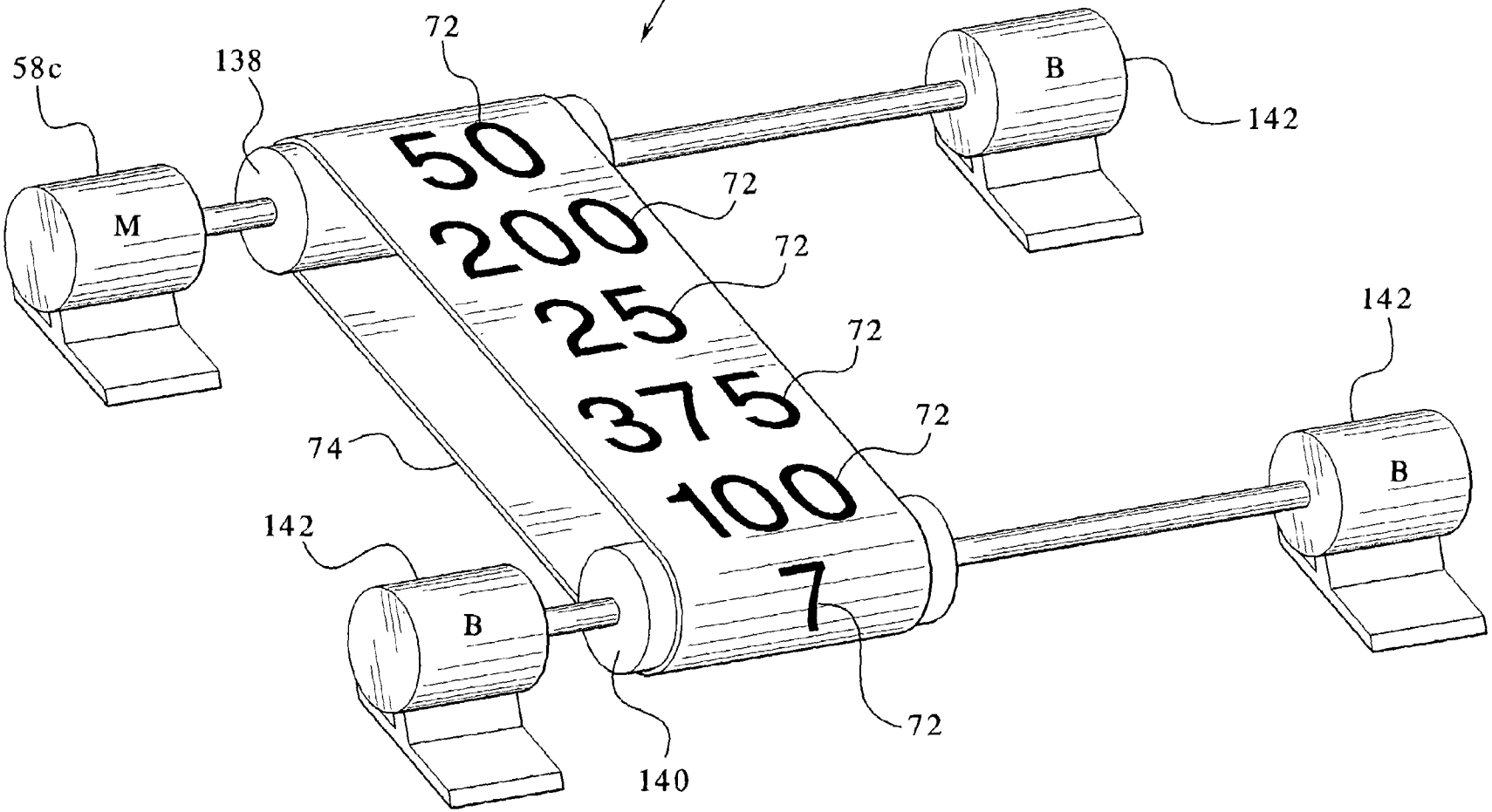
FIG. 5 is a perspective view of one embodiment for producing an elongated electromechanical reel for use in the display device of one embodiment of the present invention.

Referring now to FIG. 5, one alternative embodiment for structuring the reel 70 is illustrated. Reel 70 in FIG. 5 is elongated so that the display of symbols 72 is more conducive to having those symbols be indicated by the symbol indicator 80. Reel 70 of FIG. 5 extends through a large aperture 130 as shown in FIG. 4. The bearings, rollers and motor of reel 70 of FIG. 5 are housed safely inside game device 10 as is motor 58*c* of reel 70 in FIG. 4.

Reel 70 as illustrated in FIG. 5 includes two rollers 138 and 140. Roller 138 is a drive roller and is suitably attached to motor 58*c* (which replaces motor 58*c* of FIG. 4). Roller 138 is also coupled to a bearing 142, which are both fixed rotatably inside gaming device 10 at display area 32. Motor 58*c* can thus rotate the roller 138 clockwise or counterclockwise, and at any suitable angular speed and acceleration, as determined by the motion profile program. Motor 58*c* is a stepper motor as described above, which precisely turns roller 138 and positions belt 74. A second roller 140 is a follower roller and is suitably attached to two bearings 142, which are also fixed rotatably inside gaming device 10. The idle or follower roller 140 is driven by the belt 74, which is in tension with the rollers 138 and 140, such that the belt 74 does not slip along the rollers 138 and 140 due to gravity or due to the rotation of the rollers. When the motor 58*c* drives roller 138, belt 74 moves and in turn rotates the follower roller 140.

Belt 74 displays a plurality of symbols 72, such as the fifty, two hundred, twenty-five symbols, etc., shown in FIG. 5. Symbols 72 of belt 74 can display any indicia designed by the implementor including numerical award values, an image in conjunction with a value and a character in conjunction with a value. In certain embodiments, the display can include one or more images and/or characters. Motor 58*c*, preferably a stepper motor as described above, is programmable and can rotate the belt in two directions, using variable velocities and accelerations and stop belt at any time to display any award desired by the implementor.

It should be appreciated that other suitable mechanical and/or video apparatus and mechanism may be employed to provide the display device of the present invention.

It should be understood that various changes and modifications to the presently preferred embodiments described herein will be apparent to those skilled in the art. Such changes and modifications can be made without departing from the spirit and scope of the present invention and without diminishing its intended advantages. It is therefore intended that such changes and modifications be covered by the appended claims.

The invention is claimed is:

1. A gaming device comprising:

(a) a cabinet;

(b) a game operable upon a wager by a player; and (c) a display device connected to the cabinet and operable to indicate an outcome after an occurrence of a triggering event associated with the game, the display device including:

a rotatable reel operable to simultaneously display a plurality of symbols, and an indicator operable to rotate about an axis as the axis translates relative to the reel and operable to sequentially indicate different ones of the symbols displayed by the reel, the indicator including a plurality of pointers that are operable to sequentially point toward the reel as the indicator is rotated about the axis, and wherein the outcome is based on the symbol ultimately indicated by the indicator and the pointer of the indicator which indicates the symbol.

2. The gaming device of claim 1, wherein the outcome is selected from the group consisting of: game credits, game credit multipliers, a number of free spins, a number of free games, a number of picks from a prize pool, an entry into a bonus game and/or any combination thereof.

3. The gaming device of claim 1, which includes a video monitor operable to display the game and triggering event.

4. The gaming device of claim 1, which includes a first motion producing device operable to rotate the reel, a second motion producing device operable to rotate the indicator, and a third motion producing device operable to simultaneously translate the axis of the indicator and the second motion producing device.

5. The gaming device of claim 1, which includes a plurality of second symbols wherein one of said second symbols is associated with each pointer of the indicator and the outcome is based on: (i) the symbol indicated by the indicator; and (ii) the symbol associated with the pointer that ultimately indicates the symbol on the reel.

6. The gaming device of claim 5, wherein one of the symbols on the reel is a credit value and the second symbol is a credit multiplier.

7. A gaming device comprising:

(a) a cabinet;

(b) a game operable upon a wager by a player; and (c) a display device connected to the cabinet and operable to indicate an outcome after a triggering event associated with the game occurs, the display device including:

(i) a symbol display operable to simultaneously display a plurality of first symbols, and (ii) a first symbol indicator operable to rotate about an axis as the axis moves substantially parallel to the symbol display such that the symbol indicator indicates different ones of the first symbols displayed by the symbol display, the first symbol indicator including a plurality of pointers operable to sequentially point towards the symbol display as the first symbol indicator is rotated about the axis.

8. The gaming device of claim 7, wherein the outcome is based on which first symbol is ultimately indicated by the symbol indicator and which pointer of the symbol indicator indicates the first symbol.

9. The gaming device of claim 7, wherein the symbol display is rotatable to simultaneously display said first symbols.

10. The gaming device of claim 7, wherein the symbol display includes a video monitor operable to simultaneously display said first symbols.

11. The gaming device of claim 7, which includes a video monitor operable to display the game and triggering event.

12. The gaming device of claim 7, wherein the symbol indicator is operable to move and rotate simultaneously and at different times.

13. The gaming device of claim 12, wherein the symbol indicator and symbol display are operable to move simultaneously and at different times.

14. A method of operating a gaming device having a game operable upon a wager by a player, said method comprising:

simultaneously displaying a plurality of symbols on a symbol display;

simultaneously translating an axis of rotation of a symbol indicator relative to the display of symbols, and rotating the symbol indicator about the axis so that multiple pointers extending from the symbol indicator sequentially point towards the display; and generating an outcome, the outcome based on the symbol that is ultimately indicated by the symbol indicator and which pointer of the symbol indicator indicates said symbol.

15. The method of claim 14, which includes displaying the plurality of symbols on the symbol display from a larger set of the symbols.

16. The method of claim 14, wherein the symbol display includes a rotatable reel.

17. The method of claim 14, which includes simultaneously moving the symbols on the display.

18. The method of claim 14, which includes, at least one of, translating the indicator and rotating the indicator in multiple directions.

19. A method of operating a gaming device having a game operable upon a wager by a player, said method comprising:

simultaneously displaying a plurality of symbols on a rotatable reel;

rotating a symbol indicator about an axis as the axis translates relative to the display of symbols, wherein multiple pointers extending from the symbol indicator sequentially point towards the display; and generating an outcome, the outcome based on the symbol that is ultimately indicated by the symbol indicator and which pointer of the symbol indicator indicates said symbol.

20. The method of claim 19, which includes displaying the plurality of symbols on the symbol display from a larger set of the symbols.

21. The method of claim 19, which includes simultaneously moving the symbols on the display.

22. The method of claim 19, which includes translating the symbol indicator in parallel relative to the display of symbols.

* * * * *